US006436486B1

(12) United States Patent
Banerjee et al.

(10) Patent No.: US 6,436,486 B1
(45) Date of Patent: Aug. 20, 2002

(54) METHOD FOR DISTRIBUTING CHEMICALS THROUGH A FIBROUS MATERIAL USING LOW-HEADSPACE DIELECTRIC HEATING

(75) Inventors: Sujit Banerjee, Marietta, GA (US); Earl Malcolm, Bluffton, SC (US)

(73) Assignee: Institute of Paper Science and Technology, Inc., Atlanta, GA (US)

( * ) Notice: Subject to any disclaimer, the term of this patent is extended or adjusted under 35 U.S.C. 154(b) by 0 days.

(21) Appl. No.: 09/570,309

(22) Filed: May 12, 2000

Related U.S. Application Data

(60) Provisional application No. 60/134,301, filed on May 14, 1999.

(51) Int. Cl.[7] ..... H05H 1/00

(52) U.S. Cl. ..... 427/553; 427/308; 427/316; 427/317; 427/372.2; 427/421; 427/591; 427/595

(58) Field of Search ..... 427/308, 316, 427/317, 508, 512, 513, 553, 591, 595, 372.2, 421

(56) References Cited

U.S. PATENT DOCUMENTS 4,906,331 A 3/1990 Banerjee et al. ..... 162/72
6,029,368 A 2/2000 Blackstone et al. ..... 34/255

OTHER PUBLICATIONS

S. Avramidis, "Experiments on the Effect of Ultrasonic Energy on the Absorption of Preservatives by Wood," *Wood and Fiber Science*, Nov. 1988, 20(3), pp. 397–403.

C. Gibson et al., "Microwave Enhanced Diffusion in Polymeric Materials," *International Microwave Power Institute*, 1988, vol. 23, pp. 17–28 (no month avail).

J. Morgan, "Physical and Chemical Aspects of Preservative Treatment by Non–Pressure Methods," *Holzforschung*, 1973, 27(5), pp. 153–159 (no month avail.).

"Tappi Method T524 om–94," *Tappi Press*, Atlanta, GA, 1996, pp. 1–6 (no month avail.).

W. Su et al., "VOC Extraction From Softwood Through Low–Headspace Heating," *Holzforschung*, 1999, vol. 53, pp. 641–647 (no month avail.).

*Primary Examiner*—Bernard Pianalto
(74) *Attorney, Agent, or Firm*—Veda V. Christmas, Esq.

(57) ABSTRACT

System and method for diffusing chemicals rapidly and evenly into and through fibrous material, such as wood. Chemicals are introduced into the fibrous material by applying the chemicals to the fibrous material. After treating the fibrous material with the chemicals, the fibrous material is maintained under low-headspace conditions. Thermal energy or dielectric heating, such as microwave or radio frequency energy, is applied to the fibrous material. As a result, the chemicals are able to distribute evenly and quickly throughout the fibrous material.

39 Claims, 6 Drawing Sheets

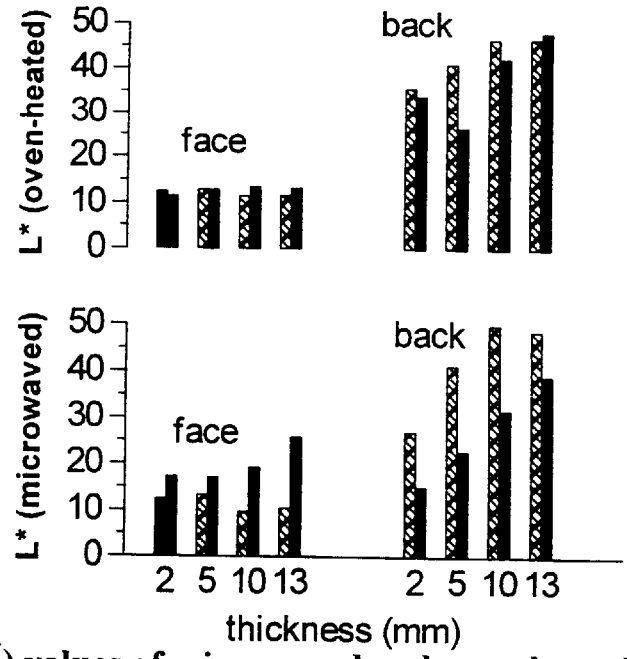
**Fig. 4a: Lightness ($L^*$) values of microwaved and oven-heated wafers. The hatched and dark bars represent pre- and post-treatment, respectively.**

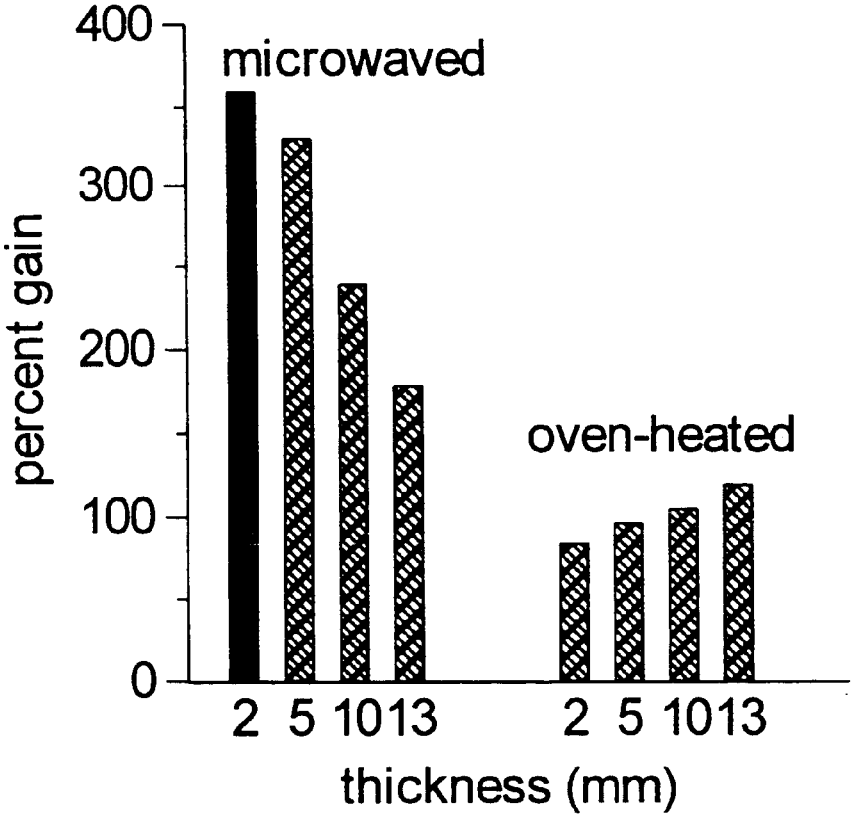
Fig. 4b: Gain in surface area of the spot (face side) after low-headspace microwaving and oven-heating.

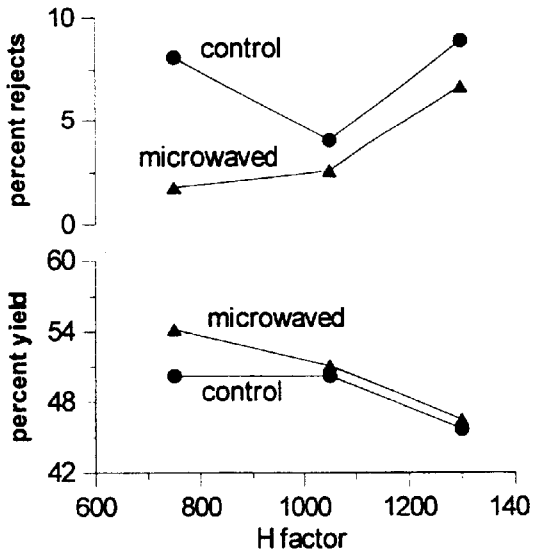
Fig. 5: Yield and rejects curves for microwaved and control chips.

METHOD FOR DISTRIBUTING CHEMICALS THROUGH A FIBROUS MATERIAL USING LOW-HEADSPACE DIELECTRIC HEATING

REFERENCE TO RELATED APPLICATIONS

This application claims the benefit of U.S. Provisional Application Ser. No. 60/134,301, filed May 14, 1999, which is incorporated herein by reference.

GOVERNMENT INTEREST

This invention was made with Government support under Contract No. DE-FC07-96IDI343, awarded by the U.S. Department of Energy. The Government has certain rights in this Invention.

FIELD OF THE INVENTION

The present invention generally relates to the chemical treatment of a fibrous material, and more particularly relates to the movement of chemicals through a fibrous material using low-headspace dielectric heating.

BACKGROUND OF THE INVENTION

Uniform chemical treatment of wood is a challenge in the paper making industry. One purpose for chemical treatment of wood is to soften wood chips so that lignin can more easily be separated from fiber for use in papermaking. If chemicals do not integrate throughout the wood, that portion of the wood that has not been treated is usually regarded as waste or requires further processing due to the inability to separate the fibers and lignin.

In chemical pulping, the wood is disintegrated through cooking in the presence of a catalyst. The ingress of the catalyst into the wood matrix is frequently rate limiting, and the speed and uniformity of pulping may be impacted due to the catalyst's poor penetration into the wood matrix. Chemical additives that improve penetration of the catalyst into wood are known in the industry as chip penetrants and are described in U.S. Pat. No. 4,906,331 to Blackstone et al., which is incorporated herein by reference. These chemical additives (referred to herein as simply "additives") and catalysts can be expensive.

In the prior art, the use of microwave irradiation for enhancing diffusion in polymeric materials is described. Specifically, one prior art method describes how the diffusion of the gas, ethylene oxide, in polyvinyl chloride is enhanced by microwave irradiation. Gibson et al., "Microwave Enhanced Diffusion In Polymeric Materials," International Microwave Power Institute 23, 17–18 (1988). Gibson et al. compared diffusion rates of the ethylene oxide in an oven to those in a cycled microwave field and found that the activation energy for diffusion was lowered considerably during microwave irradiation. Hence, the rate of diffusion in the microwave field was enhanced to an extent that exceeded the rate increase from heating. n important point to note in this prior art method is that the diffusing component, ethylene oxide, is a gas, which is naturally predisposed to diffusion into a solid.

The use of irradiated microwave energy was again applied in the prior art for the purpose of moving terpenes out of green softwood as described in U.S. Pat. No. 6,029,368 to Banerjee et al., which is incorporated in its entirety herein by reference. Banerjee et al. describes a process by which softwood flakes for the manufacture of oriented strand board, or softwood dimensional lumber are irradiated by thermal, radio frequency, or microwave energy under low-headspace conditions, such that water loss from the wood due to drying is limited to less than 10 percent by weight. A substantial fraction of the turpentine contained within the wood is removed from within the wood during the period of irradiation. However, Baneree et al. does not address the issue of enhancing the movement of chemicals into the wood to improve pulping or preservative treatment.

Therefore, there is a need for a system and method for improving the distribution of chemicals through a fibrous material. There is also a need for a system and method for preserving the moisture content of a fibrous material so as to facilitate the diffusion of chemicals into the fibrous material. There is yet another need for a system and method for the chemical treatment of a fibrous material that does not require the addition of additives. There is yet another need for a system and method that diffuses the chemicals into a fibrous material uniformly and rapidly.

SUMMARY OF THE INVENTION

The present invention solves the above-described needs by providing a system and method for distributing chemicals in a fibrous material, such as wood. Chemicals are applied to the fibrous material. Next, the fibrous material is subjected to thermal energy and/or dielectric heating, such as microwave or radio frequency energy, under conditions which significantly reduce water evaporation within the fibrous material. As a result, the chemicals are able to distribute evenly and quickly throughout the fibrous material.

In one aspect, an improved method for diffusing a chemical into a fibrous material comprises applying a chemical to a fibrous material. The fibrous material is then placed in a low-headspace environment and irradiated with dielectric heat until the chemical is diffused into the fibrous material.

The fibrous material may be selected from a group consisting of softwood, hardwood, bamboo, papyrus, paper, and straw. The dielectric heat may be either microwave energy or radio frequency energy. The low-headspace environment is designed to inhibit evaporation of water from the fibrous material, wherein it is preferable that the low-headspace environment allows at most about twenty percent evaporation of water from the fibrous material. For example, the fibrous material may be covered with an object, such as plastic, that inhibits evaporation of water from the fibrous material. Alternatively, the fibrous material may be placed in a low-headspace dielectric heater, or a dielectric heater can be filled with the fibrous material such that the amount of space remaining within the dielectric heater inhibits evaporation of water from the fibrous material.

The chemical is applied to at least one surface of the fibrous material. However, the fibrous material may be immersed in the chemical. The chemical used in the present invention is a catalyst used for pulping the fibrous material, such as a sulfur-derived compound like sodium sulfide. The chemical may also be white liquor or an anthraquinone. The chemical may also be a preservative used for preserving the fibrous material, such as borate and chromium compounds.

In another aspect, an improved method for diffusing a chemical into a fibrous material in accordance with the present invention comprises applying a chemical to a fibrous material, placing the fibrous material in a low-headspace environment, irradiating the fibrous material with thermal heat, and then irradiating the fibrous material with dielectric heat until the chemical is diffused into the fibrous material.

In yet another aspect, a system for diffusing a chemical into a fibrous material consistent with the present invention comprises a chemical treater for applying a chemical to a fibrous material and a dielectric heater for irradiating the fibrous material with dielectric heat until the chemical is diffused into the fibrous material.

The chemical treater can be a tank containing the chemical, wherein the chemical is applied to the fibrous material by immersing the fibrous material in the tank. The chemical treater can also be a sprayer for spraying the chemical onto the fibrous material. The dielectric heater preferably has a volume sized to provide a low-headspace environment that inhibits evaporation of water within the fibrous material. Preferably, the low-headspace environment allows at most about twenty percent evaporation of water from the fibrous material. In addition, the dielectric heat can be microwave energy ranging from about 300 GHz to about 3 KHz or the dielectric heat can be radio frequency energy ranging from about 300 MHz to about 3 KHz.

In this aspect, the system may further comprise a conveyor for transporting the fibrous material through the dielectric heater, where the dielectric heater has an entry location for allowing the conveyor to transport the fibrous material into the dielectric heater and an exit location for allowing the conveyor to transport the fibrous material out of the dielectric heater.

These and other objects, features, and advantages of the present invention may be more clearly understood and appreciated from a review of the following detailed description of the disclosed embodiments and by reference to the appended drawings and claims.

BRIEF DESCRIPTION OF THE DRAWINGS

FIG. 4*a* is a graph illustrating a comparison between lightness values as dye diffuses into microwaved wood and ovenheated wood consistent with an embodiment of the present invention.

FIG. 4*b* is a graph illustrating a comparison between surface area gains of microwaved wood and oven-heated wood consistent with an embodiment of the present invention.

FIG. 5 is a graph depicting the effect of applying microwave energy to wood on pulp yield and the quantity of rejects in the Kraft pulping process consistent with an embodiment of the present invention.

DETAILED DESCRIPTION

The present invention is a system and method for diffusing chemicals rapidly and evenly into and through fibrous material, such as wood. In a preferred embodiment of the present invention, chemicals are introduced into the fibrous material by applying the chemicals to at least one surface of the fibrous material or by immersing the fibrous material in the chemicals. After treating the fibrous material with the chemicals, the fibrous material is contained in a low-headspace environment, where the fibrous material is irradiated by microwave or radio frequency energy. During exposure of the fibrous material to microwave or radio frequency irradiation, the deposited chemicals ingress into the structure of the fibrous material uniformly and rapidly.

In another embodiment of the present invention, the fibrous material can be immersed in the chemicals and allowed to remain therein while being irradiated by microwave or radio frequency energy. Consequently, the chemicals rapidly and uniformly spread throughout the fibrous material.

It is appreciated by one skilled in the art that the present invention is not limited to wood, which commonly refers to both softwoods and hardwoods, but may also include other fibrous materials, such as bamboo, papyrus, paper, straw and the like. Furthermore, as used herein, a low-headspace environment is preferably an environment or condition that inhibits the loss of water from a fibrous material.

Without the use of some aid or catalyst for diffusing the chemicals into the fibrous material, the unassisted rate of diffusion of the constituent introduced into the material would be extremely slow. The present invention serves as an aid for diffusing chemicals into fibrous material by enabling the retention of a volatile component, namely water, in the fibrous material via the low-headspace restriction. The retention of water in the fibrous material makes the diffusion of chemicals into fibrous material possible. Furthermore, by subjecting the fibrous material to thermal, radio frequency, and/or microwave energy while under low-headspace conditions, the speed at which the chemicals diffuse into the fibrous material rapidly increases.

One advantage of the present invention is increased pulp yield from wood due to the uniform distribution of chemicals in the wood. The inventive method also improves absorption of chemical preservatives in wood in preservative applications. Moreover, the present invention provides the benefit of reducing the amount of additives used to facilitate the chemical treatment of wood.

Now turning to FIGS. 1–5 and the accompanying examples, various embodiments of the present invention are described.

Figure 1:
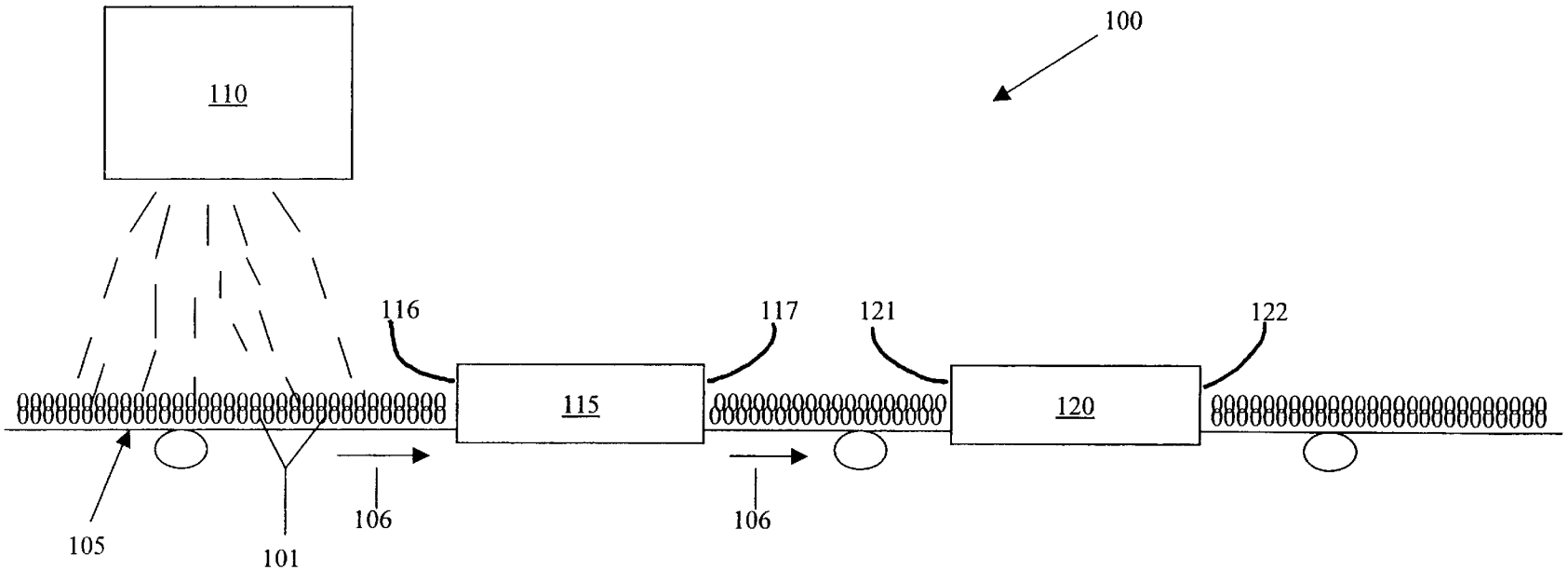
FIG. 1 illustrates a system for diffusing a chemical into wood consistent with an embodiment of the present invention.

FIG. 1 illustrates a system 100 for diffusing a chemical into wood consistent with an embodiment of the present invention. In the inventive system 100 of FIG. 1, furnish, such as wood chips 101, is conveyed on a standard conveyor 105 in the direction of arrows 106. At some point during transport on the conveyor 105, the wood chips 101 are treated with a chemical or chemicals by a chemical treater 110. Alternatively, the wood chips may be chemically treated before being placed on the conveyor. It is understood by one skilled in the art that the chemical is preferably applied to at least one surface of the fibrous material or the fibrous material may be immersed in the chemical.

The chemical treater 110 is preferably a spray device that contacts the surface of the wood with chemicals. The chemical treater may also be an immersion tank (not shown) containing chemicals, wherein the wood is soaked. Those skilled in the art will recognize that the present invention may employ any techniques commonly utilized in applying chemicals to wood.

Various chemicals, such as catalysts or preservatives, are commonly used to treat wood for the purpose of pulping or as a preservative for the wood. In the pulping process, the chemicals typically used are sulfur-derived compounds, such as sodium sulfide. Specifically, in Kraft pulping, which is a pulping process commonly known in the art, the chemicals typically used are white liquor and other chemicals such as anthraquinone. The chemicals commonly used for wood preservation include borate and chromium compounds. The present invention is not limited in any way to the previously-described chemicals, but may also include any chemical that uses water as an aid for diffusion into a fibrous material, or the present invention may use those chemicals commonly used in the art of pulping or wood preservation.

After the chemical has been applied to the wood chips 101, the wood chips 101 preferably pass through a low-headspace heater 115, which generates heat, on the conveyor 105. For example, the heater 115 may be an oven. The thermal energy from the heater 115 may be applied by conventional means, such as steam coils, electrically heated coils, gas heat, and so forth. The heater 115 has an entry location 116 and an exit location 117, whereby the furnish can pass through the heater 115 on the conveyor 105.

In one embodiment, the heater 115 may be filled to capacity with the furnish leaving as small a headspace as possible, whereby the low-headspace restriction retards the evaporation of water.

In another embodiment, the furnish may be conveyed with the conveyor 105 through the heater 115 with a flap at the entry location 116 of the heater 115 and a flap at the exit location 117 of the heater 115 to minimize the evaporation of water. The flaps can be designed such that the flaps serve as a cover to the entry and exit locations 116 and 117 of the heater 1 15 so as to inhibit evaporation of water from the furnish within the heater 115 while the flaps simultaneously allow the furnish to pass through them during transport along the conveyor 105. It will appreciated that flaps do not have to be present in the present invention.

After the wood chips 101 have been heated in the low-headspace heater 115, the wood chips 101 may then pass through a low-headspace dielectric heater 120, such as a microwave, on the conveyor 105. The dielectric heater 120 has an entry location 121 and an exit location 122 so as to allow the furnish to pass through the dielectric heater 120 on the conveyor 105. The low-headspace dielectric heater 120 can generate either radio frequency energy or microwave energy. The radio frequency energy may range from about 300 MHz to about 3 KHz. The microwave energy may range from about 300 GHz to about 300 MHz. These energies vary in accordance with the application. As a result of the wood chips 101 being exposed to the low-headspace dielectric heater 120, the chemical is uniformly diffused in the wood chips, and wood chips are prepared for easy breakdown in the pulping process.

The low-headspace heater 115 and low-headspace dielectric heater 120 can be designed such that the volume or space is sufficiently small enough to prevent evaporation of most of the water in the fibrous material when exposed to thermal, microwave, or radio frequency energy. Alternatively, the heaters 115 and 120 may be filled to capacity with the furnish leaving as small a headspace as possible so as to create a low-headspace condition that retards the evaporation of water.

Exposure of the fibrous material to thermal, microwave or radio frequency energy is preferably of sufficient duration to allow the chemical to diffuse into the material. The duration of heating depends on the nature of the chemical and the size of the furnish, and is expected to range from a few seconds to several hours. The heat from the heater 115 and/or dielectric heater 120 is applied to the furnish in a manner such that evaporation of water from the furnish is held to a minimum. The low-headspace condition may be configured to allow water retention of at least about eighty percent by weight of the fibrous material during irradiation.

In FIG. 1, exposure of the fibrous material to thermal energy from heater 115 prior to its exposure to the microwave or radio frequency energy from the dielectric heater 120 is preferably of sufficient duration to further enhance diffusion of the chemical into the fibrous material. However, such prior exposure to the thermal energy of the heater 115 is not necessary to achieve improvement in the diffusion of the chemicals into the fibrous material.

In an alternative embodiment of the present invention, the low-headspace heater 115 of FIG. 1 is removed from the system 100, and the present invention can be implemented using only a low-headspace dielectric heater 120 generating microwave or radio frequency energy.

While the system 100 of FIG. 1 is one embodiment of the present invention, it will be appreciated by those skilled in the art that the present invention may also be implemented by simply applying chemical to a fibrous material by conventional means known in the art, placing the fibrous material under low-headspace conditions, and applying thermal, microwave, or radio frequency energy for some time period sufficient to allow the chemical to diffuse into the fibrous material. In this case, a dielectric heater having only one opening serving both the entry and exit points for the furnish may be used.

Furthermore, low-headspace conditions can be created without the aid of a heater or dielectric heater having built-in low headspace. For instance, low-headspace conditions can be created by simply covering the wood with any suitable material that reduces evaporation, such as plastic, or by simply allowing the wood to remain immersed in the chemical, whereby in both cases, evaporation is severely restricted. The material used to cover the furnish however must be able to withstand the heat generated from exposure to thermal, radio frequency, or microwave energy. Consequently, thermal, microwave or radio frequency energy is applied as previously described.

Figure 2:
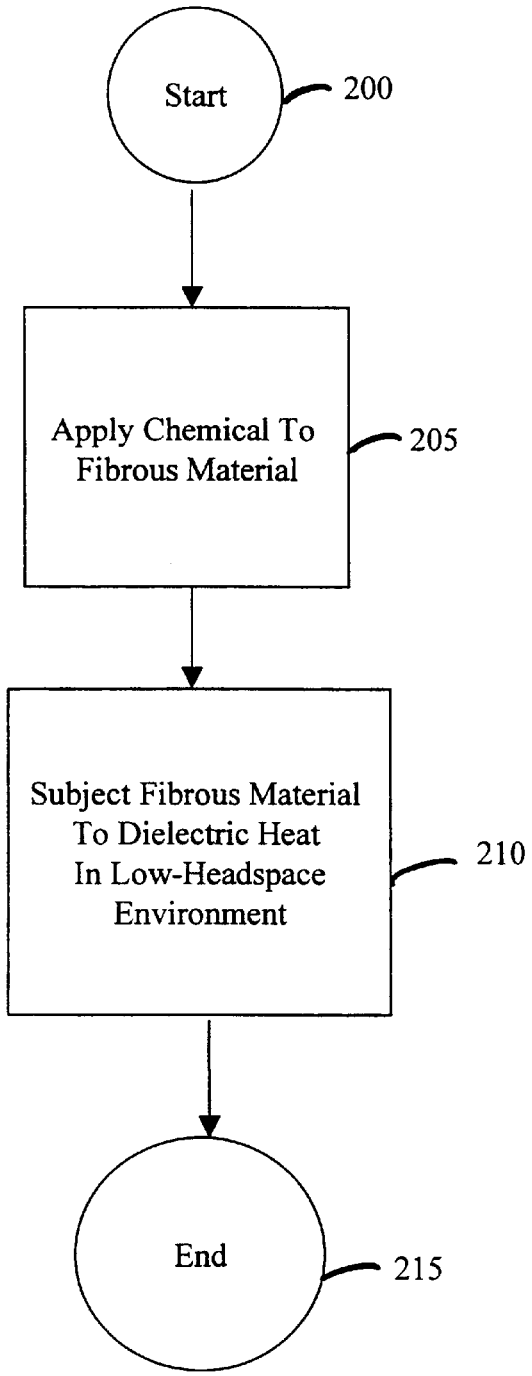
FIG. 2 is a flow diagram illustrating an exemplary process for the chemical treatment of a fibrous material in accordance with an embodiment of the present invention.
Figure 3:
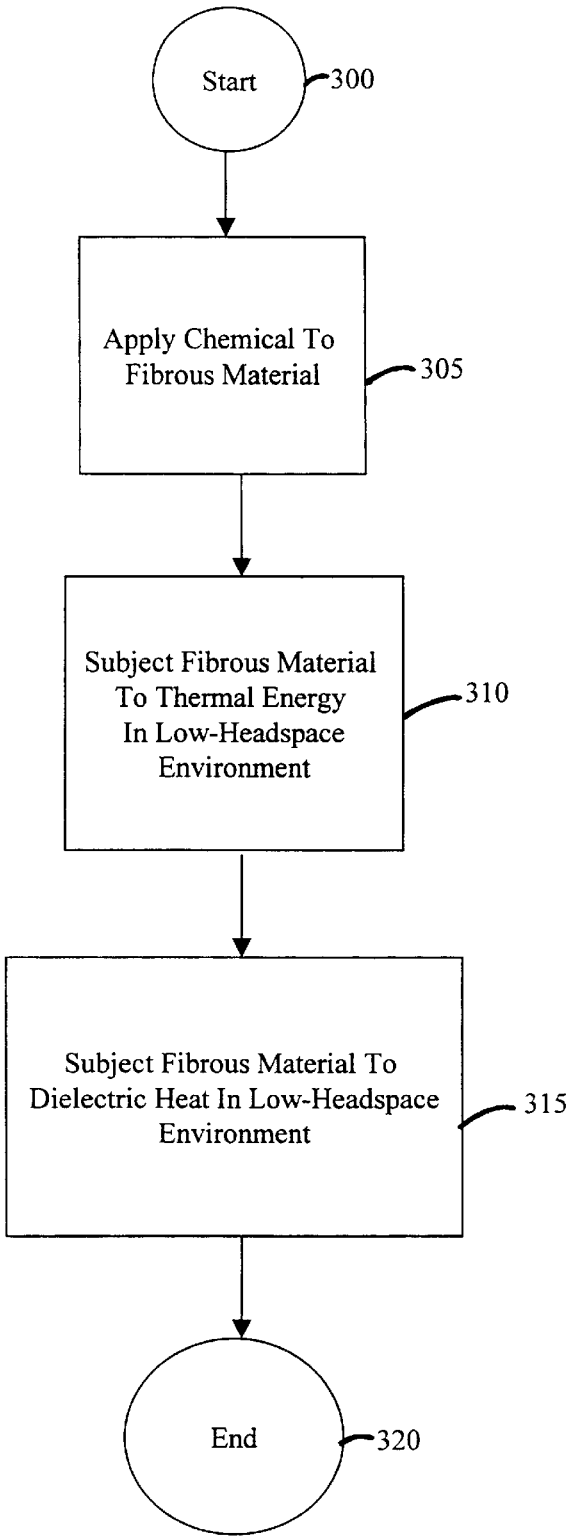
FIG. 3 is a flow diagram illustrating another exemplary process for the chemical treatment of a fibrous material in accordance with an embodiment of the present invention.

Now turning to FIGS. 2 and 3, exemplary processes for the chemical treatment of a fibrous material are illustrated in accordance with exemplary embodiments of the present invention.

Referring to FIG. 2, the process begins with the Start step 200, and in step 205, a chemical is applied to a fibrous material, such as wood. Next, in step 210, the fibrous material is subjected to microwave or radio frequency energy in a low-headspace environment until such time as the chemical has diffused into the fibrous material. The process ends in step 215, where the fibrous material is no longer subjected to the microwave or radio frequency energy.

In FIG. 3, another exemplary process for the chemical treatment of a fibrous material is shown, wherein the process begins at the Start step 300. In step 305, a chemical is applied to the fibrous material. Next, in step 310, the fibrous material is subjected to thermal energy in a low-headspace environment. After exposure to the thermal energy, in step 315, the fibrous material is then subjected to microwave or radio frequency energy in a low-headspace environment. The process ends, in step 320, where the fibrous material is no longer subjected to the microwave or radio frequency energy.

The present invention provides the benefit of uniformly and rapidly distributing chemicals throughout a fibrous material, such as wood, without the use of additives acting as catalysts to facilitate the diffusion of chemicals in the material. Further, the present invention improves pulp yields in the pulping process over other prior art methods and decreases the amount of rejects, which are wood constituents that resist pulping. Finally, the present invention improves the distribution of preservatives in wood.

The following examples are merely illustrative of the present invention.

EXAMPLE 1

The top surface of a 3.7×3.0×2.2 cm block of softwood was painted with a purple colored wood dye, Versatint purple II, which is manufactured and sold by Milliken Chemicals, Inman, S.C. This wood dye merely is illustrative of how a typical chemical that would be used for treating wood responds consistent with the system and method of the present invention.

The softwood was then wrapped in a plastic sheet to simulate low-headspace conditions and submerged in boiling water for seven minutes. A thermocouple attached to one surface of the block recorded a temperature of 84° C. After submerging the softwood in the boiling water for seven minutes, a small amount of heat-induced diffusion of the wood dye had occurred, where one could observe that the dye partially penetrated the thickness direction of the softwood.

Next, the pre-wrapped softwood was microwaved at 120 watts for four minutes, with the power being cycled to keep the surface temperature of the softwood at less than 100° C. After the softwood was microwaved, one could observe that substantially all of the dye had spread throughout the softwood, thereby demonstrating rapid and uniform diffusion of the dye in the softwood.

EXAMPLE 2

A 3.7×3.0×2.2 cm block of softwood was painted with an NaOH solution, wrapped in plastic to simulate low-headspace conditions, and microwaved at 120 watts for approximately seven minutes. The alkali perfused the block according to a phenolphthalein indicator, which is a chemical commonly used for measuring pH changes.

Conversely, when a similar experiment was performed without the low-headspace restriction, very little diffusion of the dye occurred. In addition, some of the water within the wood evaporated.

EXAMPLE 3

Slices of green pine of 3.0×3.4 cm area and 2–13 mm thick were spotted on their top surfaces or faces with 0.5 $\mu$L of Versatint purple II dye, wrapped in plastic to simulate low-headspace conditions, and microwaved for 1 minute at 60 watts. A thermocouple was placed on one surface of the slices, and the power was cycled to maintain the surface temperature at 80–95° C. for 1 minute.

On average, a weight loss of 3.3% was incurred upon microwaving. Lightness measurements were made of the spotted area before and after microwaving with known methods described by TAPPI testing method, T 524 om-94 (1994), Color of Paper and Paperboard (45°/0° geometry), TAPPI Press, Atlanta, Ga. Lightness measurements were also taken on the bottom surfaces or backs before and after microwaving. The lightness scale increases with decreasing color, and therefore, is a measure of the amount of dye located on the area being measured.

Referring to FIG. 4*a*, a graph illustrating a comparison between lightness values as dye diffuses into microwaved green pine and oven-heated green pine is shown. FIG. 4*a* indicates that after microwaving the slices of green pine under low-headspace conditions, the lightness of the spotted areas increase, thereby demonstrating departure of the dye from the faces. Moreover, after microwaving the slices of green pine, the lightness of the spotted area on the backs of the green pine slices decrease, thereby indicating the arrival of the dye at the backs.

To compare the results of microwaving slices of green pine with oven-heating, parallel experiments were run with green pine slices wrapped in aluminum and maintained in an oven such that the surface temperature of the flake also experienced a temperature of 85–90° C. for 1 minute. An average weight loss of 3.5% occurred during heating.

The changes in lightness (L*) before and after heating the slices are much smaller as compared to the corresponding changes during microwaving. As a result, it is concluded that microwaving wood under low-headspace conditions enhances diffusion of the dye to a greater extent than oven-heating wood.

In connection with FIG. 4*a*, FIG. 4*b* is a graph illustrating a comparison between surface area gains of microwaved green pine and oven-heated green pine. Specifically, the area of the spot in the microwaved slices spread considerably more in comparison to the corresponding oven-heated slices. The area of spot in the microwaved slice shows the greatest amount of spreading in the thinnest slice (2 mm). This result is due in part to the z-directional movement of the dye being more limited in the thinnest slice than in the other thicker slices. As a result, the present invention demonstrates that microwaving wood under low-headspace conditions enhances the rate of diffusion of the dye into wood to an extent greater than oven-heating wood.

EXAMPLE 4

Pine chips were soaked in white liquor prior to pulping using the Kraft pulping process. The pine chips were then subjected to low-headspace conditions and microwaved. Referring to FIG. 5, a graph depicting the effect of applying microwave energy to the pine chips is shown. Generally, FIG. 5 shows that the yield of pulp increases in accordance with the present invention in comparison to a control specimen, which had not been microwaved. In addition, FIG. 5 demonstrates that in the present invention, the amount of rejects is less than the corresponding control specimen.

Alternative embodiments will become apparent to those skilled in the art to which the present invention pertains without departing from its spirit and scope. Accordingly, the scope of the present invention is defined by the appended claims rather than the foregoing description.

What is claimed is:

1. An improved method for diffusing a chemical into a fibrous material, comprising the steps of:

(a) applying a chemical to a fibrous material;

(b) placing the fibrous material in a low-headspace environment; and (c) irradiating the fibrous material with dielectric heat until the chemical is diffused into the fibrous material.

2. The method of claim 1, wherein the fibrous material is selected from a group consisting of softwood, hardwood, bamboo, papyrus, paper, and straw.

3. The method of claim 1, wherein the dielectric heat is microwave energy.

4. The method of claim 1, wherein the dielectric heat is radio frequency energy.

5. The method of claim 1, wherein the low-headspace environment inhibits evaporation of water from the fibrous material.

6. The method of claim 5, wherein the low-headspace environment allows at most about twenty percent evaporation of water from the fibrous material.

7. The method of claim 1, wherein step (a) comprises applying the chemical to at least one surface of the fibrous material.

8. The method of claim 1, wherein steps (a) and (b) comprise immersing the fibrous material in the chemical.

9. The method of claim 1, wherein step (b) comprises covering the fibrous material with an object that inhibits evaporation of water from the fibrous material.

10. The method of claim 9, wherein the object is plastic.

11. The method of claim 1, wherein step (b) comprises placing the fibrous material in a low-headspace dielectric heater.

12. The method of claim 1, wherein step (b) comprises filling a dielectric heater with the fibrous material such that the amount of space remaining within the dielectric heater inhibits evaporation of water from the fibrous material.

13. The method of claim 1, wherein the chemical is white liquor.

14. The method of claim 1, wherein the chemical is a catalyst used for pulping the fibrous material.

15. The method of claim 14, wherein the catalyst is a sulfur-derived compound.

16. The method of claim 15, wherein the sulfur-derived compound is sodium sulfide.

17. The method of claim 15, wherein the preservative is a borate compound.

18. The method of claim 15, wherein the preservative is a chromium compound.

19. The method of claim 1, wherein the chemical is an anthraquinone.

20. The method of claim 1, wherein the chemical is a preservative used for preserving the fibrous material.

21. The method of claim 1, wherein step (a) comprises spraying the chemical on the fibrous material.

22. An improved method for diffusing a chemical into a fibrous material, comprising the steps of:

(a) applying a chemical to a fibrous material;

(b) placing the fibrous material in a low-headspace environment;

(c) irradiating the fibrous material with thermal heat; and (d) irradiating the fibrous material with dielectric heat until the chemical is diffused into the fibrous material.

23. The method of claim 22, wherein the fibrous material is selected from a group consisting of softwood, hardwood, bamboo, papyrus, paper, and straw.

24. The method of claim 22, wherein the dielectric heat is microwave energy.

25. The method of claim 22, wherein the dielectric heat is radio frequency energy.

26. The method of claim 22, wherein the low-headspace environment inhibits evaporation of water from the fibrous material.

27. The method of claim 26, wherein the low-headspace environment allows at most about twenty percent evaporation of water from the fibrous material.

28. The method of claim 22, wherein step (a) comprises applying the chemical to at least one surface of the fibrous material.

29. The method of claim 22, wherein step (b) comprises covering the fibrous material with an object that inhibits evaporation of water from the fibrous material.

30. The method of claim 29, wherein the object that inhibits evaporation of water from the fibrous material is plastic.

31. The method of claim 22, wherein step (b) comprises placing the fibrous material in a low-headspace dielectric heater.

32. The method of claim 22, wherein step (b) comprises filling a dielectric heater with the fibrous material so that the amount of space remaining within the dielectric heater inhibits evaporation of water from the fibrous material.

33. The method of claim 22, wherein the chemical is white liquor.

34. The method of claim 22, wherein the chemical is a catalyst used for pulping the fibrous material.

35. The method of claim 34, wherein the catalyst is a sulfur-derived compound.

36. The method of claim 35, wherein the sulfur-derived compound is sodium sulfide.

37. The method of claim 22, wherein the chemical is an anthraquinone.

38. The method of claim 22, wherein the chemical is a preservative used for preserving the fibrous material.

39. The method of claim 22, wherein step (a) comprises spraying the chemical on the fibrous material.

* * * * *